United States Patent [19]

Bopp

[11] Patent Number: 4,949,966

[45] Date of Patent: Aug. 21, 1990

[54] MULTIPLE PURPOSE BATON

[76] Inventor: Wolfgang Bopp, 10, Blumenweg, Rüsselsheim-Bauschheim, D-6090, Fed. Rep. of Germany

[21] Appl. No.: 174,042

[22] Filed: Mar. 28, 1988

[30] Foreign Application Priority Data

Mar. 27, 1987 [DE] Fed. Rep. of Germany ... 8704536[U]
Nov. 2, 1987 [DE] Fed. Rep. of Germany ... 8714575[U]

[51] Int. Cl.[5] ..... F41B 15/02

[52] U.S. Cl. ..... 273/84 ES; 273/84 R; 7/158

[58] Field of Search ..... 273/84 R, 84 ES; 7/104, 7/118, 158, 170

[56] References Cited

U.S. PATENT DOCUMENTS

| | | | |
|---|---|---|---|
| 442,470 | 12/1890 | Willeford | 273/84 R |
| 2,026,077 | 12/1935 | True | 273/84 R |
| 2,478,063 | 8/1949 | Strauss | 7/158 |
| 3,106,398 | 10/1963 | Gowdey | 273/84 R |
| 4,052,063 | 10/1977 | Wong | 273/84 R |
| 4,132,409 | 1/1979 | Taylor | 273/84 R |
| 4,479,171 | 10/1984 | Mains | 273/84 R |
| 4,498,669 | 2/1985 | Chan | 273/84 R |
| 4,703,932 | 11/1987 | Kubota | 273/84 R |

FOREIGN PATENT DOCUMENTS

| | | | |
|---|---|---|---|
| 736432 | 11/1932 | France | 273/84 R |

*Primary Examiner*—Edward M. Coven
*Assistant Examiner*—Mark S. Graham
*Attorney, Agent, or Firm*—Larson and Taylor

[57] ABSTRACT

A multiple purpose baton includes an elongate baton body and an elongate handle extending perpendicularly therefrom. The handle includes an impact head which can be covered by a suitable cap or surrounded by a suitable handle knob. Preferably a cutting blade or other tool or implement is provided in a hollow space at one or both ends of the baton body.

13 Claims, 2 Drawing Sheets

MULTIPLE PURPOSE BATON

FIELD OF THE INVENTION

The invention relates to a multiple purpose baton as an article of equipment especially for rescue services and for drivers, motorists, truckdrivers, and the like, consisting of a baton body and a handle mounted adjacent to the baton to the side at a right angle near an inside baton end.

SUMMARY OF THE INVENTION

Such batons are known as percussion weapons and impact weapons, with which even aggressive attacks could be warded off. The object of the invention is to disclose a multiple purpose baton based upon these known batons, which can be used as a universal article of equipment for rescue services, for police and guard services and by similar types of personnel. Starting from that concept, the range of use of this piece of rescue service equipment is also to include its use for protection and defense against violent attacks coming in many cases from third parties and also for the rescue of persons from vehicles following accidents.

The stated object is attained according to the invention in that the handle has a metal impact head at the end. This impact head serves to shatter a vehicle window, particularly the windshield, in order to free trapped persons. This impact head however can also serve to release oneself from a trapped position, for instance if a vehicle which is provided with the device would be involved in an accident.

According to the invention it is possible to shatter a vehicle windshield only with an impact force tool made especially to be suitable for that purpose. In case of an emergency, lifting jacks, swinging tow truck arms or similar tools often must be used which are only roughly suitable for this purpose.

As a result of the arrangement of the metal impact head, without increase of its weight or its dimensions, the multiple purpose baton becomes a suitable tool for the shattering of even very resistant glass surfaces for rescue purposes, such as vehicle windshields, thick door panes and window panes and the like.

According to one preferred embodiment of the invention it is provided that the metal impact head has a convexly curved front surface at its outside end. The curved front surface is in no way deleterious to other uses of the multiple purpose baton, but rather forms a very effective impact surface with which even vehicle glass panes made of safety glass can be shattered over their entire surface with just a few blows.

According to another configuration of the object of the invention it is provided that a cutting blade is arranged in a hollow space at one of the two baton ends or in the handle, where it is connected with an outer handle member forming a blade handle which can be unscrewed and is preferably embodied as a hooked safety belt cutter. During the rescue of persons trapped in vehicles, this blade can be used to cut through safety belts of which the belt latch cannot be rapidly opened following an accident. Also as a result of this blade's being mounted on the multiple purpose baton, the weight or dimensions of the baton are not increased or are only very slightly increased; the blade is then as accessiible as the described impact head wherever the multiple purpose baton is to be used.

The invention is explained in greater detail hereinafter relative to the exemplary embodiments which are shown in the drawings.

BRIEF DESCRIPTION OF THE DRAWINGS

FIG. 7 shows a modified, preferred embodiment of a multiple purpose baton in cross section.

DETAILED DESCRIPTION OF THE PREFERRED EMBODIMENTS

Figure 1:
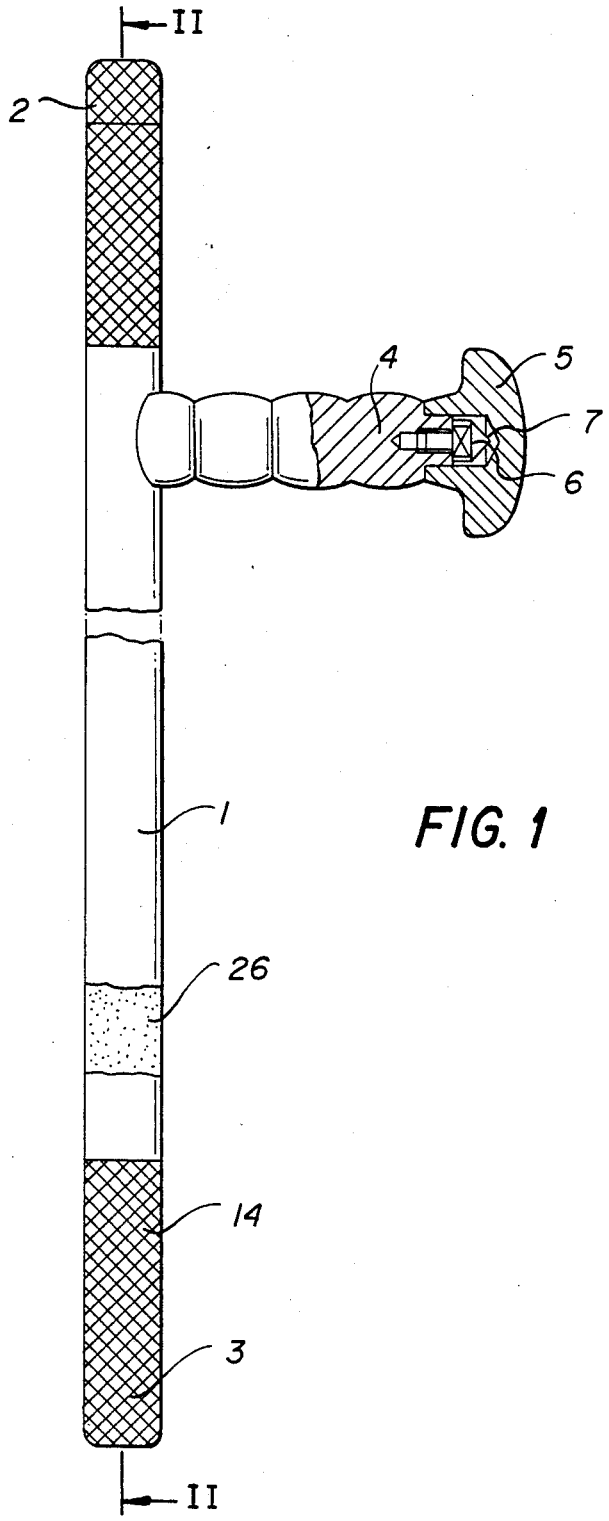
FIG. 1 shows a multiple purpose baton according to the invention in a view in which the handle is represented partially in cross section.
Figure 2:
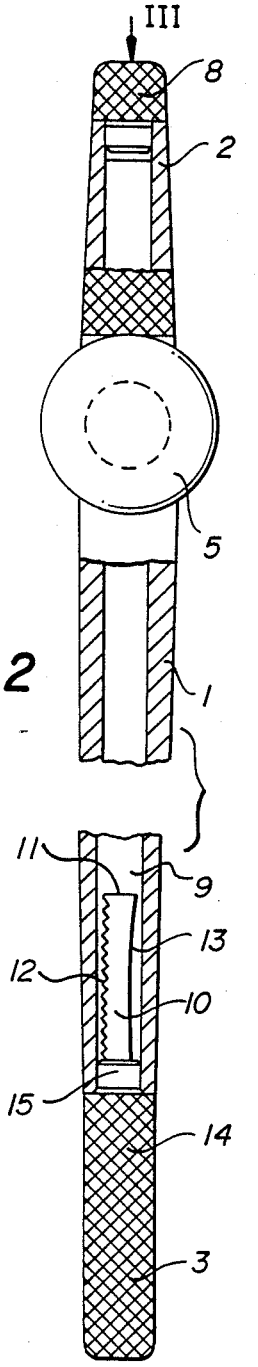
FIG. 2 shows a cross section along line II—II of FIG. 1.
Figure 3:
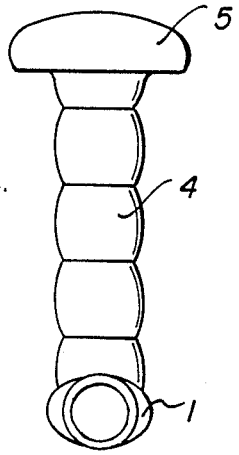
FIG. 3 shows a view in the direction of the arrow III in FIG. 2.

The multiple purpose baton shown in FIGS. 1–3 has an oblong baton body 1 of for instance approximately 0.5 m length with an inside baton end 2 and an outside baton end 3 opposite end 2. Adjacent to inside baton end 2 a handle 4 is mounted to the side and at a right angle to baton body 1, of which the surface can be configured as an anatomically shaped handle.

Handle 4 in the example shown in FIGS. 1–3 has a removable cap 5, which forms a handle knob. Under cap 5 is located a metal member 6 screwed into the front of handle 4, which has an impact head 7 on its outside end. Following removal of cap 5, which can be screwed on or be mounted thereon with a special rapid closure catch, impact head 7 is available for use, in order to shatter glass surfaces, especially windshields of vehicles, for rescue purposes.

As is shown in FIG. 3, baton body 1 is embodied as having an oval cross section in its middle area engaging handle 4, so that the diametral dimension transverse to the direction of handle 4 is greater than in alignment with handle 4. Thus the handling of the multiple purpose baton is simplified when it is used as percussion or defense weapon. When it is to be handled as a percussion weapon the multiple purpose baton is to be clutched by the upward direction handle 4 and to be moved so that handle body 1 performs so as to cause a rotary blow. For defense against the blows of an attack, the multiple purpose baton is carried so that baton body 1 lies under the underarm. Thus the inside baton end 2 projects over the user's hand grasping handle 4 and can be used as a weapon. Baton body 1 is tubular in the embodiment shown in FIGS. 1 and 3. It is closed on the inside baton end 2 with a screwed on frontal impact member 8.

A cutting blade 10 is located at the opposite outside end 3, projecting into the hollow space 9 of baton body 1, which in the exemplary embodiment which is shown has a flat blade end 11, which eliminates the possibility of its use as a stabbing weapon; it can however serve as screwdriver blade. The one side of cutting blade 10 is a sawtooth 12 and the other side a cutting blade 13. The cutting blade is inserted into a handle member 14 forming the outside baton end 3, which forms a blade handle and which can be screwed by means of a threaded member 15 into baton body 1 from which it is removable. The blade can serve to cut through safety belts for the rescue of persons from vehicles. Hollow space 9 can be used to hold small utensils.

Figure 4:
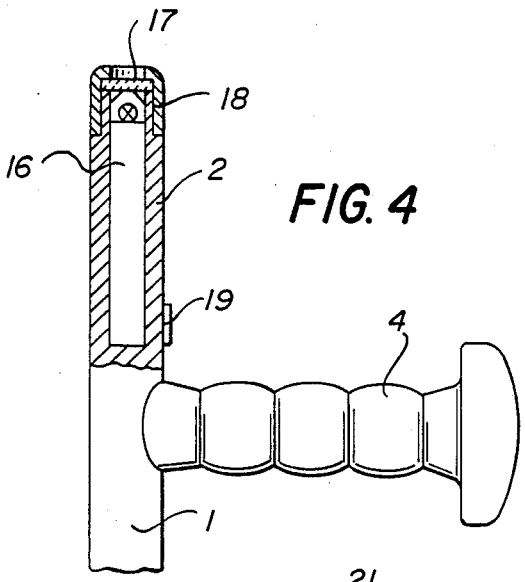
FIG. 4 shows a partial view corresponding to FIG. 1, partially in cross section, showing a multiple purpose baton with a light fixture included.

In the exemplary embodiment shown in FIG. 4 a lighting unit 16 is arranged in the inside baton end 2 and is provided with an electric battery. At the front of baton end 2 is a light egress window 17, preferably of impact-resistant glass, held by a roughcast bush sheathing 18, which projects at the front in a ring over light egress window 17. Light member 16 can be operated by a switch 19, so that the multipurpose baton replaces a flashlight. The front projecting edge of the screwed on annular roughcast bush sheathing 18 enhances the described impacting member, without thereby giving rise to the danger of any damage to light member 16 or light egress window 17.

Figure 5:
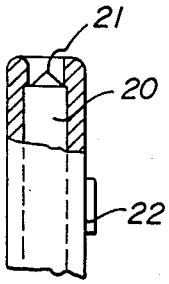
FIG. 5 shows a partial view, partially in cross section, of a multiple purpose baton with a teargas spray member.

FIG. 5 shows that a teargas spray member 20 can be arranged at one of the ends 2 or 3 in a manner similar to that of light member 16, where it has a frontal gas discharge opening 21 which can be triggered for instance by means of a button 22 which is accessible from the outside.

Figure 6:
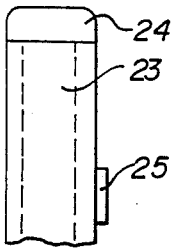
FIG. 6 shows a partial view of a multiple purpose baton with an electroshock member.

In a similar manner an electroshock member 23 can be placed at one of the two ends 2 or 3 (FIG. 6) and provided with a battery, which is electrically conductively connected with a front metal electrode surface 24 at the baton end and can be operated by a switch 25.

At several points on the outside surface of baton body 1 can be mounted a light-reflecting and/or automatically illuminating strip 26, which on the one hand simplifies finding the multiple purpose baton in the darkness and on the other hand allows the possibility of using the multiple purpose baton as a signal baton in the darkness, in which it can be easily detected in the light from vehicle headlights.

The preferred embodiment shown in FIG. 7 differs from the embodiment of FIGS. 1–3 essentially in that handle 4 has a metal impact head 27 at its end, which is inserted with a shaft 28 into a borehole 29 in handle 4. Metal impact head 27 has a convexly curved front surface 30 at its outside end, which forms the middle area of the curved front surface of a handle knob 31, which is constructed in one piece with handle 4.

The convexly curved front surface 30 forms a very effective impact surface for shattering vehicle windshields and the like made of safety glass, but without—as in the case of a pointed impact instrument—damaging the multiple purpose baton for other possible uses. Therefore no covering cap is required to cover impact head 27 when it is not in use, which then would have to be removed before the multiple purpose baton could be used for shattering a vehicle windshield.

Metal impact head 27 is inserted in a recess 32 of handle 4 or respectively handle knob 31 and is anchored there, for instance by a surrounding groove 33 at the periphery of impact head 27. The material of the handle knob 31 engages in groove 33 and forms a secure anchor.

A cutting blade 34 is located at the outside baton end 3 opposite handle 4, projecting into hollow space 9 of baton body 1, where it is embodied as a curved safety belt cutter. Safety belt cutter 34 has a cutter blade 36 only on the inside of curve 35. Injury is thus avoided when cutting blade 34 is inserted under a safety belt to be cut.

As already described for the example shown in FIG. 2, the cutting blade 34 forming a safety belt cutter is inserted in a handle or grasping member 14, which can be screwed removably into baton body 1 and forms the outside baton end 3.

I claim:

1. A multiple purpose baton comprising:

an elongate baton body having an inside end and an outside end; and an elongate handle mounted adjacent said inside end and projecting longitudinally at a right angle to said elongate baton body, said handle including (a) a handle knob provided at a distal end of said handle distant from said baton body and protruding laterally from a remainder of said handle, said handle knob including a distally opening recess, and (b) a metal impact head received in said recess such that said impact head is laterally, completely surrounded by said handle knob, except for a convexly curved outer surface of said impact head located longitudinally beyond said surrounding handle knob.

2. A multiple purpose baton as claimed in claim 1 wherein said handle includes a borehole; and wherein said metal impact head includes a shaft which is received in said borehole.

3. A multiple purpose baton as claimed in claim 1 and further including (a) a longitudinally extending bore provided in said baton body at one of said ends and having a threaded portion, (b) a cutting blade received in said bore, and (c) a handle member for said cutting blade which said handle member includes a threaded portion which is threadably received by said threaded portion of said bore such that said cutting blade is removable from said bore by unscrewing said handle member from said bore.

4. A multiple purpose baton as claimed in claim 1 wherein said baton body has a cross-sectional shape at a middle part which is oblong and elongated in a direction perpendicular to the longitudinal directions of both said handle and said baton body.

5. A multiple purpose baton as claimed in claim 4 wherein said cross-sectional shape is oval.

6. A multiple purpose baton as claimed in claim 1 and further including at least one light reflecting strip mounted on said baton body.

7. A multiple purpose baton as claimed in claim 1 and further including at least one self-illuminating strip mounted on said baton body.

8. A multiple purpose baton comprising:

an elongate baton body having an inside end and an outside end; and an elongate handle mounted adjacent said inside end and projecting longitudinally at a right angle to said elongate baton body, said handle including a metal impact head rigidly provided at a distal end of said handle distant from said baton body and a handle knob which is removably attached to said distal end to cover said impact head during normal use;

said baton body having a cross-sectional shape at a middle part which is oblong and elongated in a direction perpendicular to the longitudinal directions of both said handle and said baton body.

9. A multiple purpose baton as claimed in claim 8 wherein said impact head includes a longitudinally extending screw shaft; and wherein said handle includes a threaded bore which receives said screw shaft of said impact head.

10. A multiple purpose baton as claimed in claim 8 and further including (a) a longitudinally extending bore provided in said baton body at one of said ends and having a threaded portion, (b) a cutting blade received in said bore, and (c) a handle member for said cutting blade which said handle member includes a threaded portion which is threadably received by said threaded portion of said bore such that said cutting blade is removable from said bore by unscrewing said handle member from said bore.

11. A multiple purpose baton as claimed in claim 8 wherein said cross-sectional shape is oval.

12. A multiple purpose baton as claimed in claim 8 and further including at least one light reflecting strip mounted on said baton body.

13. A multiple purpose baton as claimed in claim 8 and further including at least one self-illuminating strip mounted on said baton body.

* * * * *